US011585135B2

(12) United States Patent
Brinkmann

(10) Patent No.: US 11,585,135 B2
(45) Date of Patent: Feb. 21, 2023

(54) LOWER DOOR SECTION HAVING A FOLDING ROLLER BRACKET

(71) Applicant: Hörmann KG Brockhagen, Steinhagen (DE)

(72) Inventor: Michael Brinkmann, Halle (DE)

(73) Assignee: Hörmann KG Brockhagen, Steinhagen (DE)

( * ) Notice: Subject to any disclaimer, the term of this patent is extended or adjusted under 35 U.S.C. 154(b) by 367 days.

(21) Appl. No.: 16/652,934

(22) PCT Filed: Oct. 2, 2018

(86) PCT No.: PCT/EP2018/076851
§ 371 (c)(1),
(2) Date: Apr. 1, 2020

(87) PCT Pub. No.: WO2019/072654
PCT Pub. Date: Apr. 18, 2019

(65) Prior Publication Data

US 2020/0263468 A1 Aug. 20, 2020

(30) Foreign Application Priority Data

Oct. 10, 2017 (DE) ..... 102017123493.4

(51) Int. Cl.
*E05D 15/24* (2006.01)
*E05D 15/22* (2006.01)

(52) U.S. Cl.
CPC ..... *E05D 15/246* (2013.01); *E05D 15/22* (2013.01); *E05D 15/242* (2013.01);
(Continued)

(58) Field of Classification Search
CPC ..... E05D 13/1215; E05D 2015/225; E05D 15/246; E05D 15/22; E05D 15/248;
(Continued)

(56) References Cited

U.S. PATENT DOCUMENTS 2,023,664 A 8/1929 Clark et al.
2,032,951 A * 3/1936 Pixley ..... E05D 15/24 160/201

(Continued)

FOREIGN PATENT DOCUMENTS

DE 10101560 A1 7/2002
EP 1630336 A1 3/2006

OTHER PUBLICATIONS

Search Report dated Apr. 18, 2019 for International Application No. PCT/EP2018/076851, 5 pages.

(Continued)

*Primary Examiner* — Justin B Rephann
(74) *Attorney, Agent, or Firm* — Schwabe, Williamson & Wyatt, P.C.

(57) ABSTRACT

A door having a door body that can be lifted, along a predetermined path, from a closed position in which it closes a wall opening into an open position in which it is located substantially overhead, the door body having two, three or more door body elements arranged one on top of the other in the closed position, is modified according to the invention in that a lower edge of the door body in the closed position and trailing during the lifting can be lifted separately, when the door reaches the open position, by a pivoting movement of a lower door body element having said edge in a lifting direction with respect to a door body element situated above it in the closed position relative to the predetermined path.

22 Claims, 3 Drawing Sheets

(52) U.S. Cl.
CPC ..... *E05D 15/248* (2013.01); *E05D 2015/225* (2013.01); *E05Y 2900/106* (2013.01); *E05Y 2900/132* (2013.01)

(58) Field of Classification Search
CPC . E05D 15/242; E05D 13/1261; E05D 15/165; E05D 15/24; E05D 15/244; E05D 15/425; E05Y 2900/106; E05Y 2900/132
See application file for complete search history.

(56) References Cited

U.S. PATENT DOCUMENTS

| | | | | |
|---|---|---|---|---|
| 2,041,372 | A | 5/1936 | Alphonse | |
| 6,076,589 | A * | 6/2000 | Hormann | E05D 15/246 160/209 |
| 6,089,304 | A * | 7/2000 | Mullet | E05D 13/1261 160/209 |
| 2009/0241423 | A1 * | 10/2009 | Benoy | E06B 3/485 49/506 |
| 2012/0180959 | A1 * | 7/2012 | Gunton | E06B 3/485 160/188 |

OTHER PUBLICATIONS

International Preliminary Report on Patentability dated Apr. 22, 2021 for International Application No. PCT/EP2018/076851, 6 pages.

* cited by examiner

LOWER DOOR SECTION HAVING A FOLDING ROLLER BRACKET

CROSS REFERENCE TO RELATED APPLICATION

The present application is a 35 U.S.C. § 371 national phase entry application of, and claims priority to, International Patent Application No. PCT/EP2018/076851, filed Oct. 2, 2018, which claims priority to German Patent Application No. DE 102017123493.4, filed Oct. 10, 2017, the disclosures of which are hereby incorporated by reference in their entirety for all purposes.

BACKGROUND

The invention relates to a door having a door body that can be lifted, along a predetermined path, from a closed position in which it closes a wall opening into an open position in which it is located substantially overhead, the door body having two, three or more door body elements arranged one on top of the other in the closed position and hinged together along articulation axes running roughly perpendicular to the predetermined path, and a lower edge of the door body in the closed position and trailing during the lifting can be lifted separately, at least when the door reaches the open position, by a pivoting movement of a lower door body element having said edge in a lifting direction with respect to a door body element situated above it in the closed position relative to the predetermined path.

Doors of this kind are used for example in the form of garage doors, factory doors, or hall doors. The door body is usually made of several pieces, in the above described manner, and in the closed position it is oriented in a vertical plane and encircled by a frame. For the opening of such a door, the door body is usually moved along a predetermined path by a guide rail assembly into an overhead position, in which it extends roughly parallel to the floor and roughly in a horizontal plane roughly perpendicular to the wall opening closed by the door body. This opening movement, the same as the closing movement from the open position to the closed position, is usually carried out with guide rails of the guide rail assembly which are situated on both sides of the door body and fixed in relation to the wall, as well as guide elements such as guide rollers which are fixed on the door body and led by the guide rails.

The guide rails usually comprise a straight vertical guide rail segment extending substantially in the vertical direction, a horizontal guide rail segment extending substantially in the horizontal direction, and an arc-shaped guide rail segment joining together the vertical and the horizontal guide rail segment. Such doors, also known as sectional doors, have the advantage that, when operated, no pivoting of the door body into the space situated in front of the building being closed with the door is needed, so that an especially space-saving operation of the door body is possible.

In practice, a number of requirements are placed on the described sectional doors:

First of all, the space situated behind the door must be closed completely and securely. In the open position, the door should free up the clear wall opening as much as possible.

Further, scant headroom is desired, i.e., the least possible spacing between the upper edge of the wall opening and the ceiling of the space being closed. Especially in the case of privately used garages, it may be required to form a wall opening whose height corresponds nearly to the room height.

Various requirements are also placed on the kinematic properties of the door body during its movement from the open to the closed position. The movement should be as fast as possible, the radius of the arc-shaped guide rail segment being limiting for the speed. Moreover, the door body should move as smoothly as possible.

In connection with these requirements, a number of possible solutions are described in the prior art, however none of them meets all requirements at the same time.

In order to achieve a satisfactory closure of the clear wall opening, the individual door body elements are situated roughly in a single plane in the closed position. In particular, the trailing door body element during the closing movement, also known as the upper door body element, and the door body elements situated below it, should lie in the same plane. In order to free up the clear wall opening as much as possible in the open position, the trailing door body element during the opening movement, also known as the lower door body element, should protrude as little as possible into the clear wall opening in the open position.

If the dimensions of the space being closed with the door body allow it, this goal can be accomplished most easily by arranging the arc-shaped guide rail segment entirely in the lintel area of the wall opening, and the horizontal and the vertical guide rail segment each have at least the length of the entire door body height. The individual door body elements can then be situated one above the other in a plane in the closed positions of the door body and entirely close the clear wall opening. In the open position, all door body elements can be situated in the horizontal guide rail segment, so that the clear wall opening is entirely opened up. In practice, especially in the case of garages, the required installation heights and installation depths for such a guide rail assembly do not exist. Further, a door body situated entirely in the horizontal in the open position significantly impedes the closing process. When initiating the closing movement, a breakaway torque needs to act on a door body at rest in the horizontal. This serves for initiating a movement of the lower edge of the door body in the vertical, until the section of the door body located in the vertical has achieved a certain minimum momentum, so that the closing movement of the door body can occur spontaneously, due to gravity, with no further external action of force. If the door body is arranged entirely in the horizontal, the required breakaway torque is a maximum, and an additional device is generally needed to initiate the closing movement by applying force to the door body.

In order to solve this problem, a thrusting device is disclosed in DE 101 01 560 A1 and in U.S. Pat. No. 2,651,360, which initiates and assists the closing movement of the door body by an action of force on the upper edge of the upper door body element. U.S. Pat. No. 2,651,360 discloses for this a thrusting device having a spring element, which is coupled firmly to the upper edge of the upper door body element. Moreover, this thrusting device is coupled at the same time to the traction means connected to the lower edge of the lower door body element, which lifts the door body from the closed position to the open position. This design requires a complicated assembly and a prolongation of the horizontal guide rail segment in order to receive the thrusting device therein.

This problem is solved in part by the thrusting device disclosed in DE 101 01 560 A1, which is not connected firmly to the upper door body element, but rather can simply be placed against it. The design of DE 101 01 560 A1, as compared to the design of U.S. Pat. No. 2,651,360, enables an easier assembly and requires a shorter horizontal guide rail segment. In both cases, however, an additional assembly step is required when installing the door.

A further problem exists in the case when the arc-shaped guide rail segment is situated at least partly in the clear opening. This problem occurs, for example, when the headroom is small as compared to the radius of the arc-shaped guide rail segment. This may be due to the fact that a large clearance height is needed for the space being closed as compared to its overall height and therefore the headroom is slight. Moreover, increasing the radius of the arc-shaped guide rail segment, which makes possible a greater speed of the door body when moving from the open to the closed position without producing annoying noise, means that the arc-shaped guide rail segment is situated at least partly in the clear opening. The problem then exists of achieving a complete closure of the clear wall opening in the closed position, among others.

To solve this problem, WO 97/42387 and EP 0 897 448 B1 disclose a door body with a pivoting lever arranged at the upper edge of the upper door body element. In the closed position of the door body, the guide rollers situated at the upper edge of the upper door body element are arranged in the arc-shaped guide rail segment. Consequently, the upper door body element is not arranged in the same plane ad the door body elements situated below it, but rather is tilted with respect to this plane. The pivoting lever now allows a tilting of the upper door body element relative to the guide rollers toward the vertical plane, so that in the closed position all door body elements can be situated in the same plane.

Such a pivoting lever is also disclosed in DE 10 2005 043 229 A1 and in DE 10 2005 008 027 U1 and it serves as an adjusting lever for moving between a closed position and a pivoting position in which the upper door body element is pivoted inward toward the arc-shaped guide rail segment. U.S. Pat. No. 5,846,127 also discloses a sectional door with such a pivoting lever.

Another possibility of achieving a complete closure of the wall opening with slight headroom is provided by the guide rail assembly disclosed in DE 101 01 560 A1. In this guide rail assembly, a second horizontal guide rail segment is arranged above the horizontal guide rail segment in the direction of gravity. This second horizontal guide rail segment only guides the upper door body element and it is located in the lintel area. The guide element arranged at the upper edge of the upper door body element is situated in the second horizontal guide rail segment in the closed position of the door body, so that the lower edge of the upper door body element is situated in the same plane as the door body element beneath it. However, this guide rail assembly, also known as a low headroom fitting, requires two horizontal guide rail segments and is thus cumbersome in its assembly and produces additional costs.

In many instances, the lower door body element in the open position protrudes into the clear wall opening. This may be due, for example, to the fact that, as just mentioned, the arc-shaped guide rail segment is arranged at least partly in the clear wall opening and the length of the horizontal guide rail segment is shorter than the height of the door body. Yet this arrangement may also be due to the fact that the traction means assembly designed to lift the sectional door from the closed position to the open position cannot lift the lower door body element entirely into the horizontal plane. Such a traction means assembly generally consists of a traction means, such as one in the form of a traction cable or a traction chain, being connected at its one end to the lower edge of the lower door body element, and its other end is coupled across guide and/or deflection rollers to a traction mechanism. The guide and/or deflection rollers are generally situated at a distance from the lintel that is less than the radius of the arc-shaped guide rail segment. When the lower edge of the lower door body element in the course of the opening movement reaches the arc-shaped guide rail segment, it ends up in a position in which the traction means coupled to the lower edge and thus also the direction of the traction force runs perpendicular to the arc-shaped guide rail segment. The lower edge has then reached its end position during the opening movement, because no further movement of the lower edge of the door body element in the opening direction can be accomplished with the aid of the traction means and the traction force exerted by it on the lower edge. The lower edge of the lower door body element in this layout is situated in its end position in the arc-shaped guide rail segment and blocks a region of the clear wall opening. Yet a protruding of the door body into the clear wall opening may also be intentional, in order to decrease the breakaway torque needed to initiate the opening movement, but also in this case an unwanted reduction of the clear wall opening must be accepted.

To solve this problem, Fr 2 694 331 A1 discloses a second vertical guide rail segment, which leads into the lintel area in order to lead the guide element fastened to the lower edge of the lower guide rail segment into the lintel area. In this way, the clear wall opening is optimally freed up. But since the lower door body element is moved toward the horizontal plane, this design requires a larger breakaway torque to initiate the closing movement.

A further solution to this problem is provided by the sectional door disclosed in EP 1 467 052 A1. In the sectional door disclosed in this document, the lower edge of the lower door body element is hinged to a guide element on each side. A traction means is fastened to the guide element on a side facing toward the space being closed. Each of these guide elements comprises two rollers, which are led in the guide rails. To move the door body from the closed position to the open position, the traction means pulls the door body upward. Upon reaching the open position, the guide rollers are situated in the arc-shaped guide rail segment. Because of the hinged connection between the guide element and the lower edge of the lower door body element, this lower edge is tilted downward in the direction of gravity in the open position. Thanks to the interaction of the traction means and the guide element hinged to the lower door body element, the lower edge of the lower door body element can be lifted up especially far. However, since the lower edge of the lower door body element is tilted downward in this design, the clear wall opening is not optimally freed up.

Doors according to the preamble of patent claim 1, in which a lower edge of the door body in the closed position and trailing during the lifting can be lifted separately, at least when the door reaches the open position, by a pivoting movement of a lower door body element having said edge in a lifting direction with respect to a door body element situated above it in the closed position and relative to the predetermined path, i.e., it is not lowered as in the doors of EP467052 A1, are described in U.S. Pat. Nos. 2,023,664, 1,990,470, WO2004/099542 A1 and EP 1630336 A1. In these known doors, the guide roller situated in the area of the lower region of the lower door body element is linked by a lever assembly to the lower door body element. This lever assembly allows for the lifting of the lower edge of the lower door body element relative to the guide roller linked there by the lever assembly, so as to entirely free up the clear wall opening. In the doors described in U.S. Pat. Nos. 2,023,664 and 1,990,470, a traction means mediating the opening movement is coupled directly to the lower edge of the lower door body element, while this traction means is coupled to the lever assembly in doors according to WO 2004/099542 A1 and EP 1630336 A1, it being assured thanks to the position of the linkage point of the lever assembly on the lower door body element possibly in combination with additional guide rollers that the lower edge of the door body element is swiveled separately in a lifting direction when the guide roller coupled to the lever assembly has reached the arc-shaped guide rail section.

Thanks to the separate lifting of the trailing edge of the door body during the opening movement upon reaching the open position, the clear wall opening in the open position can be freed up more than in the case of traditional sectional doors. The lower edge of the door body then protrudes less into the clear wall opening than is the case with traditional sectional doors. The free clearance height of the wall opening in the open position of the door body is increased in this way.

Although the clear height of the wall opening can be better utilized in the doors just described, it has been found that these doors are subject to increased wear and tear during their long-term operation.

In view of this problem in the prior art, the problem which the invention proposes to solve is to indicate doors with which both the free clearance height of the wall opening can be well utilized and a trouble-free long-term operation is assured.

According to the invention, this problem is solved by a modification of the known doors, being substantially characterized by a limiting device which limits the pivoting movement of the lower door body element in the lifting direction at least along a segment of the predetermined path.

This invention is based on the discovery that an additional degree of freedom of movement is introduced by the desired pivoting movement of the lower edge of the door body in the lifting direction upon reaching the open position, which may be disruptive and intensify the wear during other phases of the door body movement. When the door is closed, the pivoting movement of the lower door body element in the lifting direction would cause a swinging out of the lower door body element relative to the door body element located above it into the space located in front of the door body. This swinging out may result in an abrasive abutment of the lower edge of the lower door body element against the side seals, normally situated in the area of the side edges, during the course of the opening movement, which results in increased wear on the side seals. The additional degree of freedom may furthermore result in uncontrolled pivoting movements of the lower edge of the lower door body element, increasing the wear on the hinged joints between the door body elements. This can be prevented according to the invention by use of the limiting device. In this way, the wear on the doors according to the invention is also reduced when these doors are outfitted to make possible a better utilization of the clear wall opening.

The limiting device according to the invention may be designed such that it is active not only in the region of the vertical guide rail section and the first part of the arc-shaped guide rail section, but also where a lifting of the lower edge of the lower door body element is desired, i.e., in the region of the end portion of the arc-shaped guide rail section bordering on the horizontal guide rail section. In this area, the limiting device according to the invention can prevent the lower edge of the lower door body element from knocking against the deflection roller or the deflection sprocket for the traction means. This also improves the operating reliability of doors according to the invention.

In the following, the door body element which is the leading element during the opening movement or the trailing element during the closing movement shall be called the "upper door body element". The door body element which is the trailing element during the opening movement or the leading element during the closing movement shall be called the "lower door body element". If further door body elements are arranged between the upper and the lower door body element, these shall be called the "intermediate elements".

In a sectional door according to the invention, the lower edge of the lower door body element upon reaching the open position does not follow the predetermined path described by at least one of the intermediate elements in moving from the closed position to the open position, but instead the lower edge of the lower door body element upon reaching the open position is separately liftable as compared to the door body elements situated above it. Thus, the lower door body element can be moved in the direction of the plane in which the intermediate elements are situated. This plane is situated overhead. This plane may be roughly parallel to the horizontal plane. The lower door body element in the open position may be situated entirely in the plane of the intermediate elements, and thus it may lie entirely in the lintel area. In this way, the clear wall opening is entirely freed up. Yet the lower edge of the lower door body element may also block a region of the clear wall opening.

Moreover, the breakaway torque needed to initiate the closing movement may be generated by the separately liftable edge. In the open position of the door body, the separately liftable edge of the lower door body element is lifted further as compared to the lower edge of a traditional sectional door. This additional potential energy is transformed into additional kinetic energy upon moving to the closed position, which can facilitate and/or enable the initiating of the closing movement.

In one embodiment of the invention, the door comprises a first pretensioning device forcing the separately liftable edge of the lower door body element into the predetermined path upon moving from the open position to the closed position. In this way, a controlled movement of the door body can be achieved when moving from the open position to the closed position along the predetermined path. Moreover, the first pretensioning device can contribute to generating the breakaway torque needed to initiate the closing movement, since it forces the lower edge of the door body in the direction of the predetermined path. The first pretensioning device may be arranged at the lower edge of the lower door body element. Yet it may also be arranged at another point of the sectional door.

Another embodiment of the door according to the invention is characterized in that a second pretensioning device opposes a movement of the separately liftable edge in a direction orthogonal to the door body plane in the closed position of the door body. The second pretensioning device may be the same as the first pretensioning device. Yet it may also be different from the first pretensioning device. The second pretensioning device may be arranged at the lower edge of the lower door body element. Yet it may also be arranged at another area of the sectional door body. Thanks to the second pretensioning device, a satisfactory closure of the lower region of the clear wall opening can be achieved. In particular, the second pretensioning device can act counter to a forceful movement of the lower edge of the lower door body element in a direction orthogonal to the door body plane, thus preventing the formation of a gap between the door body element and the wall. This can improve the security against breaking into the space closed by the sectional door. In addition, a movement of the lower door body element in a direction perpendicular to the wall opening, caused by wind for example, and the associated noise production can be additionally prevented.

In this embodiment of the invention, it is not absolutely necessary for the limiting device to be active already in the closed position of the door body. It is enough for limiting devices to be active in an upper region of the vertical guide rail section and/or only active in a region of the arc-shaped guide rail section facing toward the vertical guide segment.

As already mentioned above, a door according to the invention can be led by a guide rail assembly along the predetermined path. The guide rail assembly may comprise two guide rails arranged at opposite edges of the door body, and each guide rail may comprise respectively at least one vertical guide rail segment running roughly parallel to the direction of gravity, at least one guide rail segment running overhead, preferably roughly in the horizontal direction, and at least one arc-shaped guide rail segment joining together the vertical and the overhead guide rail segment. The overhead guide rail segment and the arc-shaped guide rail segment may be separate from each other. Yet the overhead guide rail segment and the arc-shaped guide rail segment may also be formed as a single piece. The overhead guide rail segment may be oriented roughly horizontal. Yet it can also make an angle $\alpha>0$ with the horizontal. Such a guide rail assembly is especially suitable when the space being closed with the door body has a large height, but a slight depth.

In a further embodiment of the invention, the door body can be led along the predetermined path by an interaction of the guide rail assembly with the guide elements arranged on the door body. The guide elements may comprise rollers. Two guide elements may be arranged on each door body element. Yet more than two guide elements may be arranged on a door body element. The guide elements may be arranged at mutually opposite side edges of a door body element. According to the invention, the guide elements may be arranged in the area of the upper edge of a door body element. Yet they may also be arranged in the area of the lower edge of the door body element, or in any other area at the side edges of the door body elements.

In a sectional door according to the invention, at least one guide element may be arranged at the lower edge of the door body element having the separately liftable edge, on each of its sides facing toward a guide rail. In this way, the door body can be led especially reliably in the predetermined path. Additional guide elements can be arranged at the upper edge of the door body element. This can further improve the guidance of the door body along the predetermined path.

In a further embodiment of the invention, the liftable edge of the door body element in the open position is spaced further away from a guide element situated on this door body element in a direction running perpendicular to it than in the closed position and it is raised upward relative to the guide element. Since the guide element is situated in the guide rail assembly, the lower edge of the door body may thus be arranged above the guide rail assembly. In the event that the guide element arranged on the lower door body element is situated in the arc-shaped guide rail segment, the lower edge of the lower door body element can be lifted upward relative to the arc-shaped guide rail segment in the open position.

A further embodiment of a sectional door according to the invention is characterized in that the separate liftable door body element is connected, by means of a lever assembly making possible a changing of the distance between at least one guide element arranged on this door body element and the door body element, to the guide element. The lever assembly allows a lifting of the lower edge of the door body and a replacement of the edge in a position in which the distance between the guide element and the door body element is minimal.

The lever assembly may have a mount arranged on the door body element. A pivoting lever of the lever assembly may be connected pivotably to the mount. The pivoting lever may be connected to a guide element situated on this door body element relative to a pivot axis.

The mount may have a mounting base extending substantially parallel to the plane of the door body element. The mounting base may be connected to the door body element. This connection may occur by a screw connection, for example. Further, the mount may have a first and a second mounting side wall, extending upward from the mounting base orthogonally to it and running roughly in the direction of gravity in the closed position. The mount can be made of metal, for example. The mount side walls and the mounting base may be formed as a single piece.

The mount may receive the pivoting lever. The pivoting lever may be fastened to the mount side walls. The fastening may occur by a shaft running roughly perpendicular to and between the mount side walls. The shaft may be supported in recesses or openings in the mount side walls. The shaft may be rotatably supported.

The pivoting lever coupled in swiveling manner with the mount by means of the shaft may extend from the shaft to the lower edge of the door body element. The pivoting lever may comprise a pivoting lever base and pivoting lever side walls. The pivoting lever base may lie against the mounting base in a state in which the pivoting lever is entirely received in the mount. The pivoting lever base may then run parallel to the mounting base. The pivoting lever side walls may extend orthogonally from the pivoting lever base and extend in a direction connecting the upper and the lower edge of the door body element.

The pivoting lever may be connected to the shaft by means of the pivoting lever side walls in the area of a first end. The second end of the pivoting lever, opposite the first end of the pivoting lever, may be connected to a guide element. In the case when the guide element is a roller, the axis of the roller may be arranged in a tubular section arranged at the second end of the pivoting lever.

The function of the lever assembly is as follows: in a guiding position, the mounting base and the pivoting lever base lie against each other. The guide element is then situated adjacent to the lower edge of the lower door body element. The lower edge of the lower door body element is then led in the path predetermined by the guide rails. When the door body moves from the closed position to the open position, the pivoting lever base can be moved into a pivot position by a swiveling of the pivoting lever relative to the mount, as long as this is permitted by the limiting device. In the pivot position, the lower edge of the lower door body element is moved away from the guide element. The lower edge of the lower door body element is then spaced apart from the guide element. Thanks to the configuration of the mount and the pivoting lever, the lower edge of the door body can only be lifted upward in relation to the guide element. A downward lowering is not possible. If the door body is moved back from the open position to the closed position, the lower edge of the lower door body element will be moved back from the pivot position to the guiding position by a swiveling of the pivoting lever relative to the mount. The lower edge of the lower door body element can then be led back along the predetermined path to the closed position.

In another embodiment of the invention, the first and/or the second pretensioning device by interacting with the lever assembly can force the separate liftable edge of the door body element into the predetermined path during the movement to the closed position and/or force it into a position completely closing the wall opening in the closed position. If the door body element having the separate liftable edge is forced into the predetermined path by an interaction of the first pretensioning device and the lever assembly during the movement to the closed position, the door body can be moved especially reliably from the open position to the closed position. Moreover, this interaction of the first pretensioning device with the lever assembly can contribute to generating the breakaway torque needed to initiate the closing movement. Further, noise production can be suppressed, which is caused by the fact that the lower edge of the door body can move somewhat orthogonally to the predetermined path. Thanks to the interaction of the second pretensioning element with the lever assembly, the lower door body element can be forced into a position entirely closing the wall opening in the closed position. This can achieve an especially secure closure of the space closed by the door body. Furthermore, noise production due to a lower edge of the door body element moving back and forth for example by air pressure orthogonally to the vertical plane can be prevented. This may also be accomplished when the limiting device is not active in the closed position. The first pretensioning device and the second pretensioning device may be identical or different from each other.

In one embodiment of the invention, the first and/or the second pretensioning device may comprise a spring element. The first and/or the second pretensioning device may comprise a torsion spring. The lower edge of the lower door body element may be forced by a spring force into the predetermined path during the movement into the closed position. In the closed position, the lower edge of the door body may be forced by the spring force into a position completely closing the wall opening. The torsion spring may be mounted on the shaft of the articulation assembly. The torsion spring may comprise three legs. The first and the third legs may be formed at the opposite ends of the cylindrically shaped torsion spring. The second leg may be formed roughly in the middle between the first and the second leg. The first and the third leg may lie against the pivoting lever. The legs may lie against the pivoting lever base. The second leg may lie against the mount. The second leg may lie against the mounting base. The second leg may be U-shaped. Thanks to such an arrangement, the lower edge of the lower door body element can be forced especially reliably into the predetermined path upon moving from the open position to the closed position and be forced into a position entirely closing the wall opening in the closed position.

In another embodiment of the invention, a traction means lifting the door body from the closed position to the open position can be connected at its one end to the lower edge of the door body and can be coupled at its other end to a weight equalizing device, and the traction means can oppose the first pretensioning device.

The traction means can be a chain or a cable, for example. The traction means in the closed position of the door body may extend upward in the vertical direction, starting from the lower edge of the door body. If the weight equalizing device, such as a torsion spring assembly, is situated in the region of the end of the horizontal guide rail section facing away from the arc-shaped guide rail section, the traction means may be deflected by a deflection element situated in the area of the lintel and extend from the deflection element roughly in the horizontal direction or parallel to the overhead guide rail section as far as the weight equalizing device. The deflection element may be a chain sprocket and the traction means may be formed as a chain in a first region, facing toward the lower edge of the door body. In a second region, facing toward the weight equalizing unit, the traction means can be formed as a cable. The traction means can be made of metal.

In doors according to the invention it is possible to mount a deflection element, for example one designed as a chain sprocket, in the vicinity of the lintel and to fasten it for example to the frame supporting the vertical guide segment and/or to the wall having the wall opening. This enables a stable fastening of the deflection element in the area of structural elements which are present any way, or the wall. This arrangement is possible without impairing the clearance height in the case of doors according to the invention, since the lower edge of the lower door body element can be lifted separately and this pivoting movement in the lifting direction is not impaired by the guide roller mounted in the area of the lower edge, as is the case with traditional doors. In these doors, the traction force of the traction means works, as explained above, perpendicular to the arc-shaped guide rail segment if the deflection element is arranged in the vicinity of the wall opening. Then a continuation of the opening movement is no longer possible.

The weight equalizing device serves to make the opening movement easier by forcing the door body toward the open position, at least in the closed position. The weight equalizing device may also prevent an uncontrolled closing movement, thereby obeying relevant safety precautions. The weight equalizing device may comprise a mechanical spring, such as a tension spring or a torsion spring, which engages with the door body via the traction means. The weight equalizing device is usually tensioned by means of the weight of the door body under the action of gravity, usually during the closing movement of the door body. The opening movement is then assisted with the spring tension so created.

In the following, the movement of the door body of a sectional door from the closed position to the open position shall be described, the door body being lifted by the traction means. The traction means engages with the lower edge of the door body in order not to excessively strain the hinged connections of the door body elements in the course of the opening movement. Instead, it is possible with this arrangement for the individual door sections to be braced against each other during the opening and closing movement and to be supported overall by the traction means fastened to the lower edge of the door body. The traction means is led across deflection rollers so that during the entire opening movement of the door body a force acts on the lower edge of the lower door body element that is oriented upward, roughly parallel to the direction of gravity. In the closed position of the door body, the lower edge of the lower door body element is forced into a position entirely closing the wall opening by an interplay of the lever or articulation assembly and the second pretensioning element (which may be identical to the first pretensioning device). The lower edge of the lower door body element is situated near the guide element arranged on this door body element. The guide element may be fashioned as a roller, for example. The guide element is arranged in the guide rail assembly and is led by it.

The door body element is now lifted upward by the traction means. The guide element arranged at the lower edge of the lower door body element moves on account of the constrained guidance by the vertical guide rail segment roughly upward in the vertical direction. Due to the interplay of the first pretensioning element, such as a torsion spring, and the articulation assembly, the lower edge of the lower door body element also follows the path of the guide element. The lower edge of the lower door body element and the guide element together follow this vertical path until such time as the guide element enters the arc-shaped guide rail segment. Due to the constrained guidance by the arc-shaped guide rail segment, the guide element continues to follow the arc-shaped path of the guide rail assembly. However, the traction force of the traction means continues to act on the lower edge of the lower door body element roughly upward and parallel to the direction of gravity. Since the lever or articulation assembly allows a swiveling of the lower edge of the lower door body element upward relative to the guide element, the lower edge of the lower door body element is consequently lifted upward at once and/or as much as this is possible due to the limiting device. The lower edge of the lower door body element is then spaced away from the guide element in the vertical direction. The clear wall opening is further freed up in this way. The upper door body element and the intermediate elements in this condition are situated in an overhead position predetermined by the overhead guide rail segment.

This opening movement may occur under the assistance of the pretensioned weight equalizing device. The traction means may work against the first pretensioning device, possibly assisted by the weight equalizing device, when lifting the door body. The pretensioning device can be pretensioned by the traction force of the traction means. This pretensioning force may contribute to creating the break-away torque needed to initiate the closing movement, thereby making possible and/or assisting the movement of the door body from the open to the closed position.

In addition to the overhead guide rail segment, a second guide rail segment can be arranged above the first overhead guide rail segment. This second overhead guide rail segment may receive at least guide elements such as guide rollers at the upper edge of the upper door body element. In this way, the headroom can be further reduced. While in the open position of the door body at least the intermediate elements lie roughly in the same plane, the lower door body element is tilted with respect to this plane. The lower door body element makes an acute angle β with the plane of the intermediate elements. In a traditional sectional door without separately liftable edge, the lower door body element lies in a plane subtended by the upper edge of the lower door body element and the guide element arranged in the arc-shaped guide rail segment. In a sectional door according to the invention with a separately liftable edge, the lower edge of the door body is moved upward relative to the guide element. This decreases the acute angle β made by the lower door body element with the plane of the intermediate elements. Thus, the clear wall opening is further freed up.

The limiting device provided according to the invention may be especially compact in design if it has limiting elements which are carried along by the door body in the course of the door body movement. In this case, it is not absolutely necessary to provide a limiting device extending across the entire door body in the area of the wall opening.

In this regard, it has proven to be especially expedient when the traction means, such as a roller chain, is coupled to the lower edge of the door body by a coupling device arranged at the lower edge and able to pivot relative to a pivot axis running parallel to the articulation axes, the pivot axis being situated beneath the lever axis in the closed position, relative to which the pivoting lever with the guide roller can swivel in relation to the lower edge of the lower door body element. The pivotable mounting of the coupling device makes it possible to swivel this, under the tractive action of the traction means upon reaching the open position, in a direction opposite to the lifting direction relative to the lower door body element, so that the hinge point of the traction means on the coupling device is swiveled upward relative to the lower edge of the lower door body element upon reaching the open position. Thus, both the lower edge of the lower door body element is swiveled upward in the lifting direction relative to the door body element situated on top of it in the closed position, and the coupling device is swiveled upward in a direction opposite the lifting direction. In this place, it is pointed out that the pivoting lever, during a pivoting movement of the lower edge of the lower door body element relative to the door body element situated on top of it in the closed position in the lifting direction relative to the lever axis, is swiveled in a direction opposite the lifting direction or in an opposite direction of rotation.

Utilizing this kinematics, the limiting device may have an especially compact design if it comprises a limiting element coordinated with the coupling device and able to pivot with it relative to the pivot axis and a limiting element coordinated with the lever assembly and able to pivot with it relative to the lever axis. The region in which the limiting device is active can be individually adjusted by the distance between the lever axis and the pivot axis on the one hand and the disposition of the limiting elements on the other hand.

In the mentioned compact design of the limiting device, one of the limiting elements may comprise a limiting link at least partly embracing the lever axis and/or the pivot axis, while the other limiting element is designed as an end stop element abutting against the limiting link during a pivoting movement of the lower door body element in the lifting direction.

The limiting link may comprise a collar extending transversely from a bracket of the coupling device that runs roughly perpendicular to the articulation axes, especially roughly perpendicular to this, while the end stop element can be mounted on the pivoting lever and comes to bear against the limiting surface of the limiting link facing toward the pivot axis during the pivoting movement of the lower door body element in the lifting direction or during a pivoting movement of the pivoting lever relative to the lever axis in a direction opposite the lifting direction.

In order to monitor the functional ability of the doors according to the invention and with a view to securing the doors in event of damage to the traction means and/or a weight equalizing device, there is generally provided a so-called slack cable protection, by which the tension of the traction means coupled to the lower edge of the door body is monitored and upon falling below a predetermined minimum tension an appropriate intervention in the control system of the door body movement is triggered. In doors according to the invention, a corresponding slack cable sensor can be provided on the side of the limiting link facing toward the pivot axis. A cable serving for relaying the signal of the sensor to a control device can be fixed on the side of the limiting link facing away from the pivot axis. For this, the limiting link itself may be outfitted with appropriate hooks or the like, which can be used to clamp the cable. In addition or alternatively to this, a cable guide element, especially one made of plastic, can be fixed on the side of the limiting link facing away from the pivot axis, with which the signal cable can be held in order to prevent a clamping of the signal cable during the pivoting movement of the coupling device.

The limiting device serves primarily for limiting an uncontrolled and unwanted movement of the lower edge of the lower door body element relative to the door body element situated above it in the closed position or relative to the guide rail assembly before reaching the open position. But it should also make possible the desired pivoting movement of the lower door body edge in the lifting direction upon reaching the open position.

For this reason, it is preferably provided according to the invention that the end stop element is released in the course of the opening movement of the door body not later than upon reaching the open position by the limiting link. Accordingly, the limiting link encircles the pivot axis or the lever axis only partly, so that the pivoting movement of the limiting link in the course of the opening movement results in a releasing of the end stop element. In this way, the radial spacing of the limiting link from the pivot axis can be increased in a circumferential direction of the pivoting link relative to the pivot axis opposite the lifting direction. It can also be accomplished in this way that the pivoting link forms an inlet funnel, facilitating the correct abutment of the end stop element against the pivoting link in the course of the closing movement of the door body.

Once the end stop element is freed up by the pivoting link, the lower edge of the lower door body element can be pivoted upward freely with no further measures in the lifting direction. This produces the risk that the lower edge of the lower door body element might knock against the deflection element for the traction means possibly situated in the lintel area of the wall opening in the course of the pivoting movement in the lifting direction. This unwanted knocking can be prevented if the limiting device has a fixed guide surface interacting with a limiting element arranged at the lower edge of the door body upon reaching the open position, such as a guide roller which can turn about an axis of rotation running parallel to the articulation axes. This fixed guide surface can be arranged on the wall comprising the wall opening and can extend upward at a slant in the upper region of the wall opening, especially in the region of the arc-shaped guide rail section.

As already mentioned above, traditional doors can have a thrusting device situated at the end of the horizontal or overhead guide rail segment facing away from the arc-shaped guide rail segment and able to be placed in the opening movement against the leading edge of the door body during an opening movement. Such a thrusting device may also be used in the context of the invention to force the guide element arranged at the lower edge of the door body in the open position against the guide surface.

In doors according to the invention, a complete freeing up of the clear height of the building opening can also be achieved if the radius of curvature of the arc-shaped guide rail segment is especially large in order to reduce the polygon acceleration occurring when the door body elements pass through the arc-shaped guide rail segment. In the context of the invention, it has proven to be especially expedient for the radius of curvature of the arc-shaped guide rail segment at an inner guide surface thereof to be 400 mm or more, preferably 420 mm or more, especially preferably 450 mm or more, in particular 500 mm or more. In this case, the guide rail assembly of a door according to the invention may comprise supplemental rails interacting with leading guide means situated in the area of the leading edge of the leading door body element during the opening movement in order to ensure a complete closure of the wall opening in the closed position, for the reasons mentioned in connection with traditional doors, having a third straight segment above the second straight segment and roughly parallel to it. The inner radius of the arc-shaped, especially circular arc-shaped segment in the sense of an optimizing of the leverage ratio of the lever assembly can be less than 800 mm, preferably less than 700 mm, especially 600 mm or less.

Of course, the polygon accelerations occurring during the opening and closing movement depend not only on the inner radius of the arc-shaped guide rail segment, but also on the height of the individual door body elements. In the sense of optimizing the polygon acceleration on the one hand and the number of door body elements required for a given height of building opening on the other hand, it has proven to be expedient for the ratio of the inner radius to the height of at least one door body element in a direction running parallel to its side edges and perpendicular to the articulation axes to be 0.6 or more, preferably 0.65 or more, especially preferably around 0.68 or 0.8 or less, preferably 0.75 or less, especially preferably 0.7 or less. It has been found that, when the ratio of the inner radius and the height of the individual door body elements is increased beyond a value of 0.6-0.7, only a slight reduction in the polygon accelerations is observed at constant speed of movement of the door body. The height of the door section here refers to the height of the visible surface of an individual door section in the closed position in the mounted state. If door sections are used with finger protection profiles at the upper and lower edges, such as are described in EP 370376 A, the height of a protrusion in the area of the upper door section edge, situated in the closed position in a recess at the lower edge of the panel located on top of it, will not be counted when determining the door section height. The door section height then may also be determined such that the height is measured between the upper vertex of the recess receiving the mount on the lower edge of the door section and the upper vertex of the protrusion. Accordingly, the door section height in the case of a door section arranged between two door sections in the closed position means the vertical distance between the articulation axes associated with this door section in the closed position.

BRIEF DESCRIPTION OF THE DRAWINGS

The invention shall be explained in the following with reference to the drawing, which should be consulted for all details essential to the invention and not explicitly mentioned in the specification. The drawing shows.

DETAILED DESCRIPTION

Figure 1:
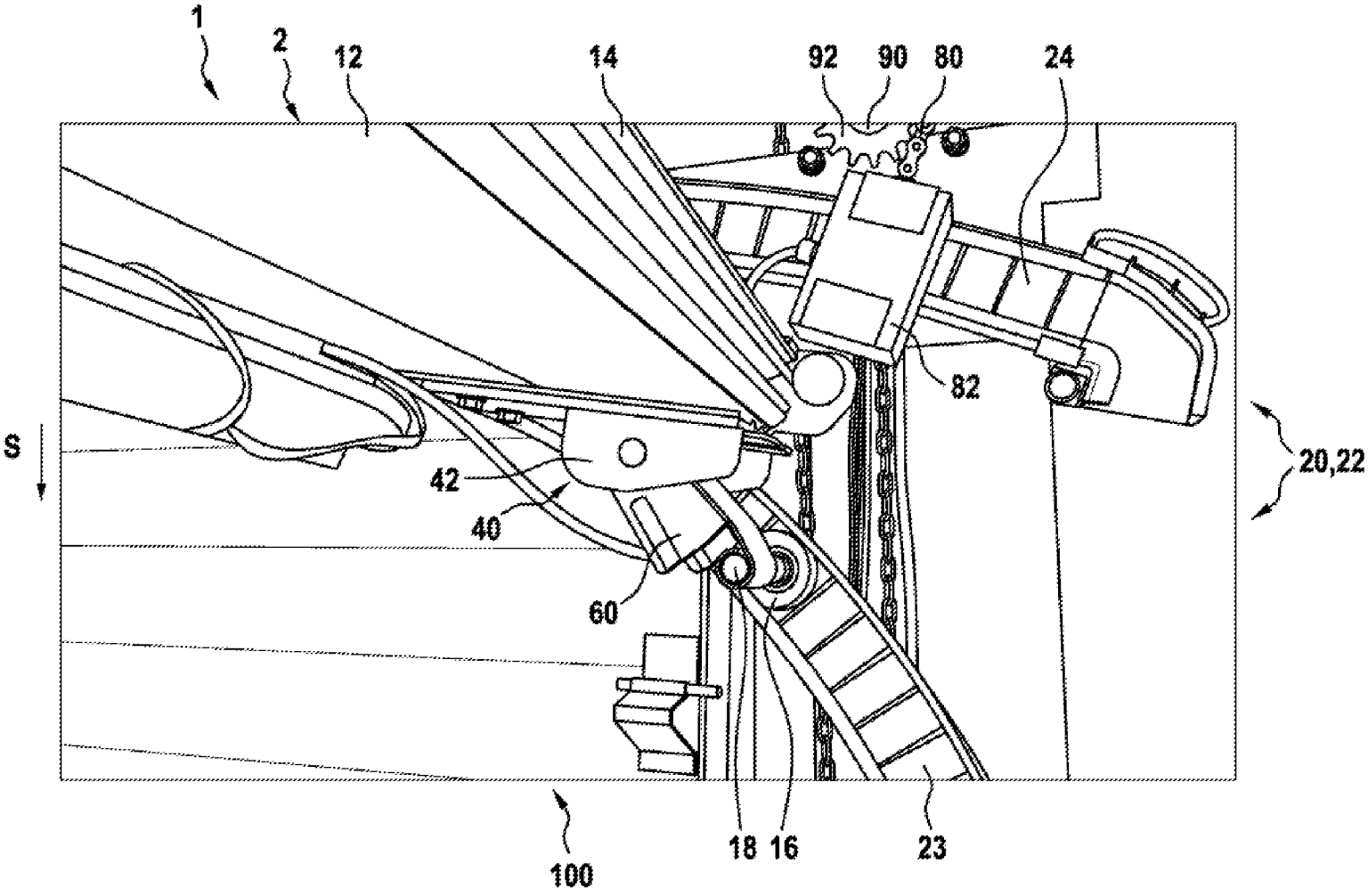
FIG. 1 a perspective view of a cut-out portion of a sectional door in the open position, FIG. 2 a perspective view of a cut-out portion of a sectional door shortly before reaching the closed position, FIG. 3 a limiting device of a door according to the invention in the closed position and FIG. 4 the limiting device of FIG. 3 in the open position

FIG. 1 shows a cut-out portion of a perspective view of a sectional door 1 in the open position. The door body 2 of the sectional door 1 has been moved from the closed position to the open position by a chain 80, which is fastened to the lower edge 14 of the door body 2 via a coupling device 82, which is pivotably mounted on the lower edge 14 of the door body 2. The chain 80 is coupled via a deflection roller 90 having a chain sprocket 92 to a driving device, not shown. The door body 2 comprises multiple door body elements 10, 12. In the figure, only the lower door body element 12 can be seen. The door body elements are hinged together by a preferably roughly horizontal articulation axis with respect to a roughly perpendicular path predetermined by a guide rail assembly 20 (see FIG. 2). In the closed position (see FIG. 2), the door body elements 10, 12 are arranged one above the other. The door body 2 is then located roughly in the vertical plane. The door body element which is situated near the floor in the closed position is called the lower door body element 12. This door body element 12 is the trailing door body element during the movement from the closed position to the open position. The leading door body element during the movement from the closed position to the open position is called the upper door body element. Further door body elements may be arranged between the upper door body element and the lower door body element. These door body elements are called intermediate elements.

The guiding of the door body 2 from the open position to the closed position and vice versa along a predetermined path occurs thanks to the interplay of a guide rail assembly 20 and guide elements, which are configured in FIG. 1 in the form of rollers 16.

The guide rail assembly 20 comprises two guide rails 22, which are arranged on opposite side walls of the wall opening 100. In FIG. 1, only one of the two guide rails can be seen. The guide rails 22 comprise a vertical guide rail segment 26 (not seen in FIG. 1), a roughly horizontal overhead guide rail segment (not seen in FIG. 1), and an arc-shaped guide rail segment 22 joining the vertical guide rail segment 26 and the horizontal guide rail segment. The guide rail assembly 20 shown in FIG. 1 additionally has a second overhead guide rail segment 24 to mount the guide element arranged at the upper edge of the upper door body element. This second overhead guide rail segment 24 is arranged above the overhead guide rail segment in the direction of gravity S. In the open position, the intermediate elements are situated in the plane dictated by the overhead guide rail segments. The upper edge of the lower door body element 12 in the open position is also situated in the plane subtended by the intermediate elements. In the open position, the rollers 16 situated on the lower edge 14 of the lower door body element 12 are arranged in the arc-shaped guide rail segment 22. The rollers 16 are connected to the lower door body element 12 not rigidly, but via a lever assembly 40 (see FIG. 2) able to swivel relative to the lower door body element 12.

The lever assembly 40 comprises a mount 42 and a pivoting lever 60. The pivoting lever 60 is connected to the mount 42 at one end 64*a* and able to swivel relative to a lever axis 68. At its second end 64*b* situated opposite the first end 64*a*, the pivoting lever 60 is connected to the roller 16. The connection of the roller 16 to the pivoting lever 60 is by way of the roller axis 18 being received in a tubular mount 69 of the pivoting lever 60. Further details about the articulation assembly 40 will be presented afterwards with reference to FIG. 2.

FIG. 1 shows the lever assembly 40 in the pivot position. The separately liftable edge 14 of the lower door body element 12 is lifted upward relative to the roller 16. The lifting is done by applying a traction force in a chain 80 fastened by a coupling device 82 to the liftable edge 14 of the lower door body element 12. The liftable edge 14 is situated above the arc-shaped guide rail section 22. The clear wall opening 100 is further freed up as compared to traditional sectional doors in which the rollers 16 are not connected pivotably to the door body element 14. Moreover, the separately liftable edge has greater potential energy as compared to a door body in which the lower edge is not pivotably connected to the rollers. This is transformed into kinetic energy during the closing movement and helps generate the breakaway torque. The lifting of the lower edge 14 of the lower door body element 12 occurs against the restoring force of the pretensioning device 30, described below. The pretensioning device 30 thus finds itself in a pretensioned state. If the door body 2 is moved from the open position shown in FIG. 1 to the closed position shown in FIG. 2, the restoring force of the pretensioning device 30 has the effect of forcing the lower edge 14 of the lower door body element 12 against the roller 16. This provides a further contribution to the breakaway torque needed to initiate the closing movement. Moreover, the lower edge of the lower door body element 12 can be reliably led in the path predetermined by the guide rail assembly 20. The pretensioning device 30 thus corresponds to the first pretensioning device.

Figure 2:
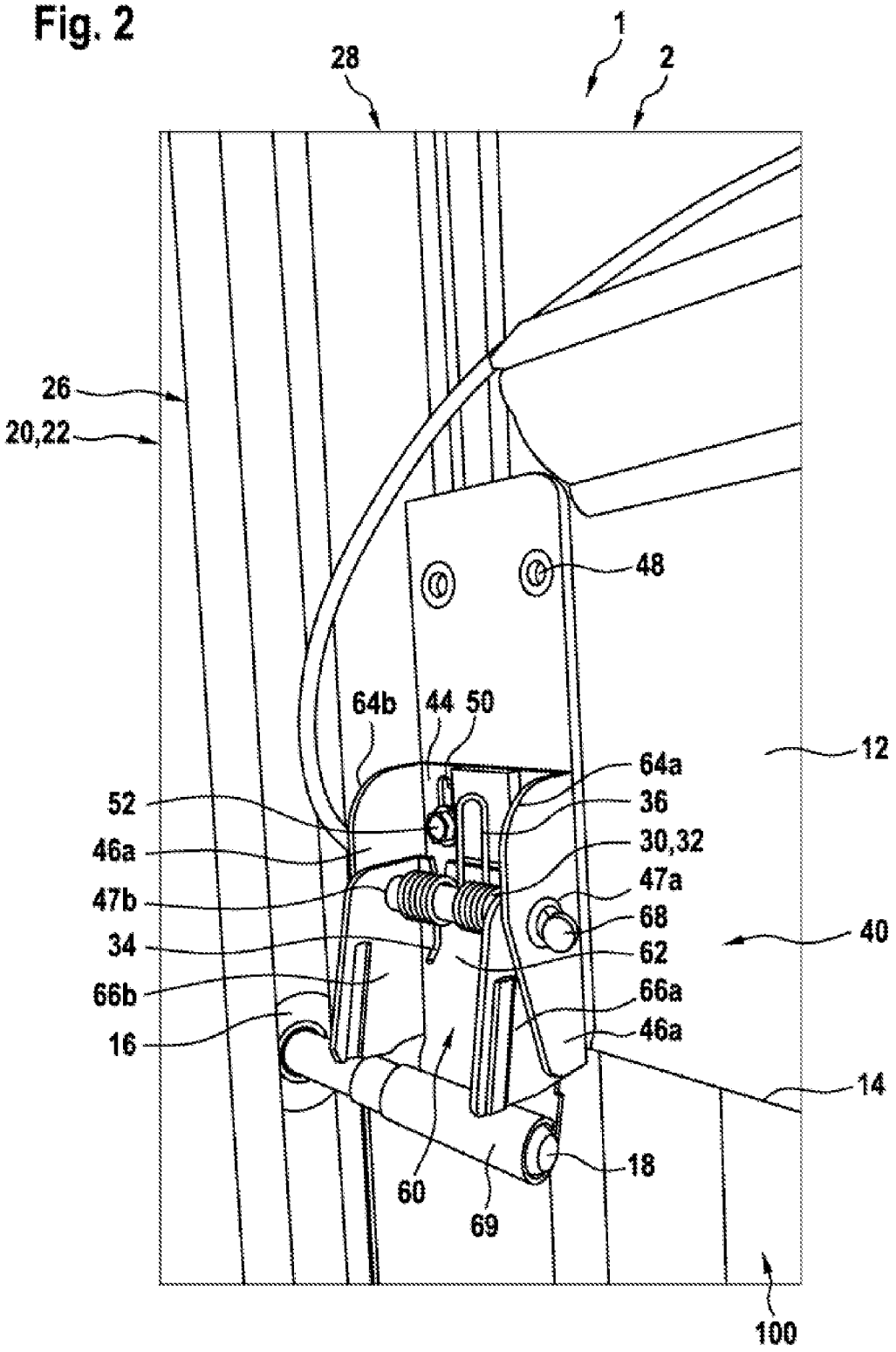

FIG. 2 is a perspective view of a cut-out of the sectional door 1 shortly before reaching the closed position. The figure shows a guide rail 22 of the guide rail assembly 20. In the cut-out, only the vertical guide rail segment 26 is depicted. This is fastened to a frame member 28.

Moreover, FIG. 2 shows the lower door body element 12 with the separate liftable edge 14. The runner 16 is fastened to the separate liftable edge 14 of the lower door body element 12. The runner 16 is connected via the lever assembly 40 to the lower door body element 14 and can pivot relative to it. The chain 80 for lifting and lowering the door body 2 is fastened via the coupling device 82 (cf. FIG. 1) to the lower edge 14 of the lower door body element 12.

In the following, the lever assembly 40 of the door 1 according to the invention shall be described. The lever assembly 40 comprises a mount 42 and a pivoting lever 60. The pivoting lever 60 is connected pivotably to the mount 42 by the lever axis 68. The mount 42 comprises a mounting base 44, a first mounting side wall 46*a* and a second mounting side wall 46*b*. The mount 42 is connected via the mounting base 44 firmly to the lower door body element 12. The mount 42 is connected in the region of the liftable edge 14 of the lower door body element 12 to the latter. For the fastening of the mount 42, fastening holes 48 and oblong holes 50 are formed in the mounting base 44. In FIG. 2, the mount 42 is connected by a screw 52 led through the oblong hole 50 to the door body element 12. The mounting base 44 extends roughly parallel to the lower door body element 12. The mounting base 44 is fashioned roughly rectangular. But it may also have any other shape. The first mounting side wall 46*a* and the second mounting side wall 46*b* are situated, in the closed position, in a lower region of the mount 42. The first and the second mounting side wall 46*a*, 46*b* extend from the mounting base 44 roughly perpendicular to the mounting base 44, and extend roughly in the direction of gravity S. The first mounting side wall 46*a* is arranged at a first side edge of the mounting base 44. The second mounting side wall 46*b* is arranged at a second side edge of the mounting base 44, so that the second mounting side wall 46*b* is situated opposite the first mounting side wall 46*a*. In the first mounting side wall 46*a* there is formed a first opening 47*a*, and in the second mounting side wall 46*b* a second opening 47*b*. A shaft 68 extending between the first mounting side wall 46*a* and the second mounting side wall 46*b* and determining the lever axis is received by the first opening 47*a* and the second opening 47*b* and secured in the mount 42. The shaft 68 serves for coupling the pivoting lever 60 to the mount 42. The pivoting lever 60 comprises a pivoting lever base 62, a first pivoting lever side wall 66*a* and a second pivoting lever side wall 66*b*. In the guide position shown in FIG. 2, the pivoting lever base 62 is situated roughly parallel to the mounting base 44. The pivoting lever base 62 consequently extends roughly parallel to the lower door body element 12. The pivoting lever base 62 is formed roughly rectangular and has a dimension which allows the pivoting lever base 62 to be received entirely by the mount 42. Extending out from the pivoting lever base 62 are a first pivoting lever side wall 66*a* and a second pivoting lever side wall 66*b*, such that the first pivoting lever side wall 66*a* lies opposite the second pivoting lever side wall 66*b*. The first pivoting lever side wall 66*a* and the second pivoting lever side wall 66*b* are also received entirely by the mount 42. The shaft 68 is firmly connected to the first pivoting lever side wall 66*a* and the second pivoting lever side wall 66*b*. The shaft 68 is arranged at a first end 64*a* of the pivoting lever. Thanks to this design, the pivoting lever 60 can swivel relative to the mount 42 by the lever axis 68 in a direction away from the plane of the lower door body element. At a second end side 64*b* of the pivoting lever 60 situated opposite the first end side 64*a* there is formed a tubular mount 69 to hold the roller axis 18. Hence, the roller 16 is firmly connected by the roller axis 18 to the pivoting lever 60. The pivoting lever 60 can swivel with respect to the mount 42 firmly connected to the lower door body element 12. Hence, the lower edge 14 of the lower door body element 12 can swivel with respect to the guide roller 16.

The articulation assembly 40 shown in FIG. 2 moreover comprises the pretensioning device 30. This pretensioning device 30 in the closed position, as represented in FIG. 2, forces the door body into a closed position completely closing the wall opening 100. Thus, the pretensioning device 30 also corresponds to the second pretensioning device. The pretensioning device 30 comprises a torsion spring 32. This torsion spring 32 comprises a first leg 34, a second leg 36 and a third leg 38 (not shown). The first and the third leg 34, 38 are respectively formed at the end sides of the torsion spring facing toward the first and second pivoting lever side wall 66*b, c*. The torsion spring 32 encircles the shaft 68 of the pivoting lever 60. The first leg 34 (and also the third leg 38 not shown here) lies against the pivoting lever base 62. The second leg 36 is formed roughly in the middle of the torsion spring 32. The second leg 36 is U-shaped. The U-shaped segment of the second leg 36 lies against the mounting base 44 of the lever assembly 40. In order to move the lever assembly 40 from the guide position shown in FIG. 2 to the pivot position shown in FIG. 1, the pivoting lever 60 and the mount 42 must be swiveled toward each other against the restoring force produced by the torsion spring 32. By this restoring force, the lower edge 14 of the lower door body element 12 can be forced in the closed position shown in FIG. 2 into a position completely closing the wall opening 100. Moreover, as was already mentioned above, the pretensioning device 30 can force the lower door body element 12 into the path dictated by the guide rail assembly 20 during a movement from the open position shown in FIG. 1 to the closed position shown in FIG. 2. Another function of the pretensioning device 30 is that it can generate the breakaway torque needed to initiate the closing movement. When the door body 2 is lifted upward by means of the chain 80, the torsion spring 32 is pretensioned by the swiveling of the pivoting lever 60. If the tension exerted by the chain 80 on the lower edge of the door body 2 decreases, a force will be exerted on the lower edge 14 of the lower door body element 12 by virtue of the spring force of the torsion spring 32, and this can initiate the closing movement of the sectional door.

Figure 3:
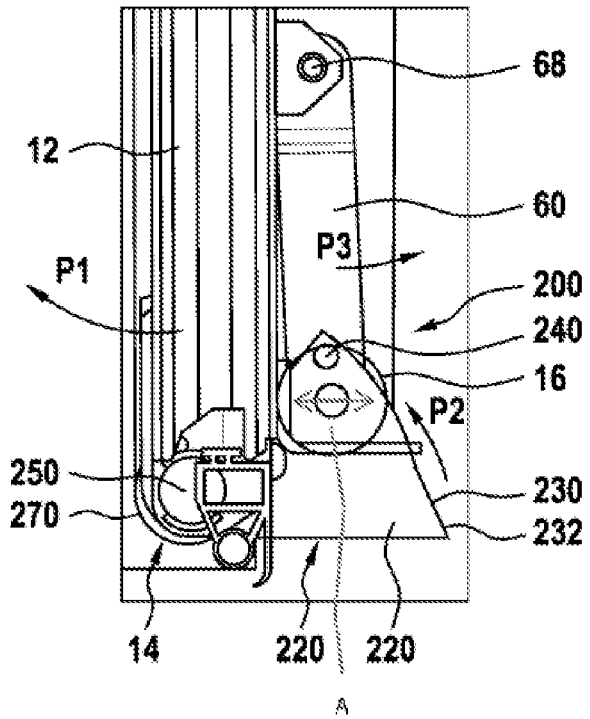
Figure 4:
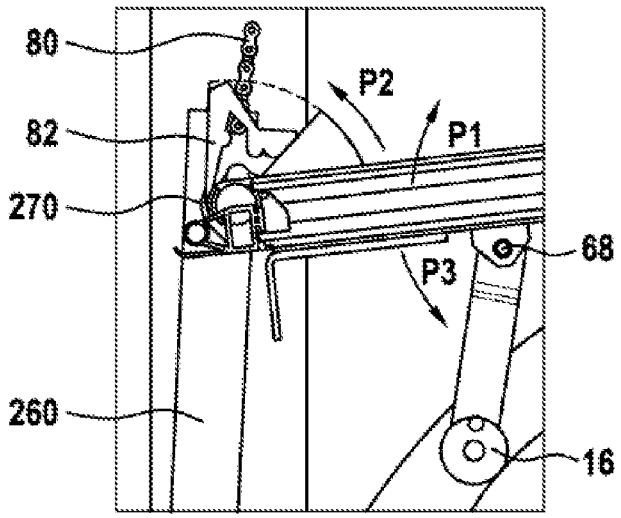

FIGS. 3 and 4 show schematically the limiting device of a door according to the invention. The limiting device 200 comprises a first limiting element 220 and a second limiting element 240. The first limiting element 220 can swivel together with the coupling device 82 about a pivot axis 250 relative to the lower door body element 12. The pivot axis 250 runs parallel to the articulation axes, relative to which the individual door body elements are hinged together. The limiting element 220 comprises a holding plate 220 extending roughly perpendicular to the pivot axis 250 and a limiting link 230 in the form of a collar 230 partially encircling the pivot axis 250, situated at the edge of the holding plate 220 facing away from the pivot axis 250 and extending roughly perpendicular to that edge. The limiting element 240 is in the form of an end stop element arranged on the pivoting lever 60. The end stop element in the embodiment of the invention explained with the aid of the drawing is fashioned in the form of a stop pin extending roughly parallel to the pivot axis 250. The end stop element 220 and the end stop element 240 are arranged next to, in the drawing of FIG. 3 behind the door body element 12, in the direction of the pivot axis 250. In the closed position shown in FIG. 3, the limiting pin 240 comes to bear against the limiting link 230 upon swiveling of the pivoting lever 60 in the direction of the interior space closed by the door in the direction indicated by the arrow P3. Likewise, the limiting link 230 comes to bear against the limiting piece 240 upon swiveling of the lower door body element 12 in the lifting direction indicated by the arrow P1. In this way, a swinging out of the lower door body element 12 in the direction indicated by the arrow P1 relative to the guide roller 16 arranged on the pivoting lever 60 is prevented. A swinging in of the door body element 12 in the direction opposite the lifting direction P1 can be prevented with the aid of an end stop not shown in the drawing and mounted stationary on the pivoting lever 60.

Upon moving of the door body from the closed position shown in FIG. 3 to the open position shown in FIG. 4, the coupling device 82 and thus also the limiting link 230 are swiveled under the traction force of the traction means 80, designed as a roller chain at least in the region of a segment coupled to the door body, in the direction indicated by the arrow P2 relative to the lower edge 14 of the door body element 12 about the pivot axis 250. As can be appreciated by comparing FIGS. 3 and 4, the limiting element 240 configured as a limiting pin is released by the limiting link 230 in the course of the pivoting movement of the limiting link 230 about the pivot axis 250 and can be swiveled in the direction indicated by the arrow P3 relative to the lower door body element 12 about the lever axis 68. This enables a swiveling movement of the lower door body edge 14 in the lifting direction indicated by the arrow P1 relative to the door body element located above it in the closed position. As can be seen especially clearly in FIG. 2, the radial spacing of the limiting collar 230 from the pivot axis 250 increases in a direction opposite the arrow P2. This makes possible a gradual deflection of the pivoting lever 60 relative to the door body element 12 about the lever axis 68 to initiate the pivoting movement of the door body element 12 in the lifting direction. At the same time, an inlet funnel is formed in the region 232 of the limiting collar 230 with larger radial spacing from the pivot axis 250, which makes it easier to thread the limiting pin 240 arranged on the pivoting lever 60 in the course of the closing movement of the door body. The pivoting movement of the pivoting lever 60 about the lever axis 68 in the direction P3 opposite the lifting direction P1 can be limited by an end stop, not shown, which is arranged on the pivoting lever 60. This reduces the risk of the lower edge 14 of the lower door body element 12 being forced under the action of the traction force mediated by the roller chain 80 against the deflection sprocket deflecting the roller chain 80. In addition, the limiting device 200 comprises a guide surface 260 situated in the upper region of the building opening being closed with the door body, extending upward at a slant. The guide surface is associated with another limiting element situated in the region of the lower edge of the door body element 12. In the embodiment of the invention shown in the drawing, the further limiting element is a roller 270 mounted rotatably relative to the pivot axis 250 and protruding beyond the lower edge 14 of the door body element 12.

As already described above, the upper edge of the door body which is the leading edge during the opening movement arrives in the course of the opening movement at a thrusting device, associated with the guide rail assembly 20, which is arranged for example in the form of a compression spring. Under the action of the compression spring, the limiting roller 270 is forced against the stationary limiting surface 250, thus making possible a low-play guiding of the door body movement in the area of the lower edge 14, while at the same time the lower edge 14 of the door body element 12 can be lifted separately in the lifting direction 81. It should be noted that the pivoting lever 60 and the limiting element 220 are swiveled in the course of the opening movement of the door body in the same direction of turning relative to the lever axis 68 or the pivot axis 250, while the lower edge 14 of the door body element 12 is swiveled in an opposite lever turning direction relative to the door body element situated above this lower door body element 12 in the closed position. The invention is not limited to the exemplary embodiments explained with the aid of the drawings. Instead, a limiting device with a pivoting link arranged on the pivoting lever 60 and a limiting pin associated with the coupling device 82 can also be provided. In advantageous embodiments of the invention, the position of the limiting pin 240 and the limiting link 230 are attuned to each other so that there is a noncontact movement of these parts relative to each other without the intervention of outside forces. The lever axis 68 is arranged above the pivot axis 250 in the embodiment of the invention shown in the drawing. In the embodiment of the invention shown in the drawing, the guide roller 16 is situated between the lever axis 68 and the pivot axis 250. In all embodiments of the invention, the coupling device 82 may be used at the same time as a catching device, which prevents a dropping of the door body if the traction means breaks or the weight equalization device coupled to the traction means fails.

In the embodiment of the invention shown in FIGS. 3 and 4, the roller 16 associated with the lower door body edge is fastened on the door body element 12 via a pivoting lever 60 arranged pivotably on the lower door body element relative to a lever axis 68. In order to assure a low-friction and nonwearing movement of the roller 16 in the guide rail assembly, it is necessary for the roller axis of the guide roller 16 to have a predetermined spacing from the inner limiting surface of the lower door body element 12 at least in the closed position of the door body. From this standpoint, the installation of doors according to the invention can be made easier if the spacing between the roller axis of the guide roller 16 and the inner limiting surface of the lower door body element 12 can be adjusted separately with a suitable adjustment device. In one preferred embodiment of the invention, the guide roller 16 is fastened by a cam assembly to the pivoting lever 60. Depending on the rotary position of the cam assembly relative to a cam axis running parallel to the roller axis, the distance of the axis of rotation of the guide roller 16 from the inner limiting surface of the lower door body element 12 can be changed, as indicated by the arrow A in FIG. 3.

In addition or alternatively, the pivoting lever 60 can be associated with an adjusting bolt braced against the inner limiting surface of the lower door body element 12 or an extension piece, with which a pivot position of the pivoting lever 60 in the door body closed position can be adjusted by swiveling it relative to the lever axis 68 in the direction indicated by the arrow P3 or in a direction opposite to this, in order to likewise adjust the position of the axis of rotation of the guide roller 16 in the direction indicated by the double arrow A. The adjusting bolt may be implemented, for example, in the form of a screw bolt, passing through a thread arranged stationary on the pivoting lever 60 and braced against the door body element 12 or an extension piece.

LIST OF REFERENCE SYMBOLS

1 Sectional door
2 Door body
10 Door body element
12 Lower door body element
14 Lifting edge
16 Roller
18 Roller axes
20 Guide rail assembly
22 Guide rails
23 Arc-shaped guide rail segment
24 Second overhead guide rail segment
26 Vertical guide rail segment
28 Frame member
30 Pretensioning device
32 Torsion spring
34 First leg
36 Second leg
38 Third leg
40 Articulation assembly
42 Mount
44 Mounting base
46*a* First mounting side wall
46*b* Second mounting side wall
47*a* First opening
47*b* Second opening
48 Fastening hole
50 Oblong hole
52 Screw
60 Pivoting lever
62 Pivoting lever base
64*a* First end side
64*b* Second end side
66*a* First pivoting lever side wall
66*b* Second pivoting lever side wall
68 Shaft/lever axis
69 Tubular mount
80 Chain
82 Coupling device

90 Deflection roller
92 Chain sprocket
100 Wall opening
S Direction of gravity

The invention claimed is:

1. A door having a door body that is to be lifted, along a predetermined path, from a closed position in which the door closes a wall opening into an open position in which the door is located substantially overhead, the door body having two, three or more door body elements arranged one on top of the other in the closed position and hinged together along articulation axes running roughly perpendicular to the predetermined path, wherein a lower edge of the door body in the closed position and trailing during the lifting is to be lifted separately, at least when the door reaches the open position, by a pivoting movement of a lower door body element having said edge in a lifting direction with respect to a door body element situated above the lower door body element in the closed position relative to the predetermined path, characterized by a limiting device which limits the pivoting movement of the lower door body element in the lifting direction at least along a segment of the predetermined path, wherein a traction means lifting the door body from the closed position to the open position is connected at one end of the traction means to the lower edge of the door body by a coupling device and is coupled at another end of the traction means to a weight equalizing device, said coupling device arranged at the lower edge and able to pivot relative to a pivot axis running parallel to the articulation axes, and wherein the traction means opposes a first pretensioning device configured to force the separately liftable edge of the lower door body element into the predetermined path upon moving from the open position to the closed position, wherein the lower door body element with the separately liftable edge is connected to a guide element by means of a pivoting lever of a lever assembly making possible a changing of a distance between the guide element arranged on the door body element and the lower door body element, wherein the guide element is pivoted upon reaching the open position, by a pivoting of the pivoting lever relative to a lever axis in a direction opposite the lifting direction with respect to the lower door body element, wherein the limiting device comprises a first limiting element coordinated with the coupling device and able to pivot with the first limiting element relative to the pivot axis, and a second limiting element coordinated with the lever assembly and able to pivot with the second limiting element relative to the lever axis, wherein the first limiting element comprises a limiting link at least partly embracing the lever axis or the pivot axis, the pivot axis being situated beneath the lever axis in the closed position, wherein the limiting link comprises a collar extending transversely from a bracket of the coupling device that runs roughly perpendicular to the articulation axes, and an end stop element of the second limiting element is mounted on the pivoting lever and comes to bear against the limiting surface of the limiting link facing toward the pivot axis during the pivoting movement of the lower door body element in the lifting direction.

2. The door according to claim 1, wherein a second pretensioning device opposes a movement of the separately liftable edge in a direction orthogonal to the door body plane in the closed position of the door body.

3. The door according to claim 2, characterized in that the first or the second pretensioning device comprises a spring element.

4. The door according to claim 2, characterized in that the first or the second pretensioning device comprises a torsion spring.

5. The door according to claim 1, wherein the door is guided by a guide rail assembly along the predetermined path.

6. The door according to claim 5, wherein the guide rail assembly comprises two guide rails arranged at opposite edges of the door body, and each guide rail comprises respectively at least one vertical guide rail segment running roughly parallel to the direction of gravity, at least one guide rail segment running overhead, in the horizontal direction, and at least one arc-shaped guide rail segment joining together the vertical and the overhead guide rail segment.

7. The door according to claim 5, wherein the door body is led along the predetermined path by an interaction of the guide rail assembly with the guide elements arranged on the door body.

8. The door according to claim 7, wherein the guide elements comprise rollers.

9. The door according to claim 7, wherein at least one guide element is arranged at the lower edge of the door body element having the separately liftable edge, on each of the sides of the door body element facing toward a guide rail.

10. The door according to claim 7, wherein the liftable edge of the door body element in the open position is spaced further away from a guide element situated on the door body element in a direction running perpendicular to it than in the closed position and it is raised upward relative to the guide element.

11. The door according to claim 7, wherein the separate liftable door body element is connected, by means of the pivoting lever of the lever assembly, to the guide element, wherein the guide element is pivoted upon reaching the open position by a pivoting of the pivoting lever relative to a lever axis in a direction opposite the lifting direction with respect to the lower door body element.

12. The door according to claim 11, wherein the first and/or a second pretensioning device forces the separate liftable edge of the door body element into the predetermined path during the movement to the closed position and/or forces it into a position completely closing the wall opening in the closed position.

13. The door according to claim 1, characterized in that the traction means is coupled to the lower edge of the door body by a coupling device arranged at the lower edge and able to pivot relative to a pivot axis running parallel to the articulation axes.

14. The door according to claim 13, characterized in that the coupling device under an action of the traction means is pivoted in a direction opposite the lifting direction relative to the lower door body element upon reaching the open position.

15. The door according to claim 1, characterized in that one of the limiting elements comprises the end stop element abutting against the limiting link during the pivoting movement of the lower door body element in the lifting direction.

16. The door according to claim 1, characterized in that the end stop element is released upon reaching the open position by the limiting link.

17. The door according to claim 1, characterized in that the limiting device comprises a fixed guide surface interacting with a third limiting element arranged on the lower edge of the lower door body element upon reaching the open position.

18. The door according to claim 17, characterized in that the fixed guide surface is arranged on the wall and extends upward at a slant.

19. The door according to claim 17, characterized by a thrusting device situated at an end of the overhead guide rail segment facing away from an arc-shaped guide rail segment and able to be placed in the opening movement against the leading edge of the door body during an opening movement, by which the third limiting element arranged at the lower edge of the door body is forced in the open position against the guide surface.

20. The door according to claim 19, characterized in that the radius of curvature of the arc-shaped guide rail segment at an inner guide surface thereof is 400 mm or more.

21. The door according to claim 19, characterized in that the inner radius of the arc-shaped guide rail segment is less than 800 mm.

22. The door according to claim 21, characterized in that a ratio of the inner radius to the height of at least one door body element in a direction running parallel to side edges of the at least one door body element is 3:5 or more, or less than 3:4.

* * * * *